US010208933B1

(12) United States Patent
Seligman et al.

(10) Patent No.: US 10,208,933 B1
(45) Date of Patent: Feb. 19, 2019

(54) ADJUSTABLE LIGHT FIXTURE AND LIGHTING SYSTEM

(71) Applicant: Forum Lighting, Inc., Pittsburgh, PA (US)

(72) Inventors: Steven Seligman, Export, PA (US); Nicholas Brahm, Pittsburgh, PA (US); Wescott Israel, Glenshaw, PA (US)

(73) Assignee: Forum Lighting, Inc., Pittsburgh, PA (US)

( * ) Notice: Subject to any disclaimer, the term of this patent is extended or adjusted under 35 U.S.C. 154(b) by 0 days.

(21) Appl. No.: 15/671,868

(22) Filed: Aug. 8, 2017

(51) Int. Cl.

| | |
|---|---|
| ***F21S 4/00*** | (2016.01) |
| ***F21V 21/22*** | (2006.01) |
| ***F21V 21/005*** | (2006.01) |
| *F21Y 103/10* | (2016.01) |
| *F21Y 115/10* | (2016.01) |
| *F21S 8/00* | (2006.01) |
| *F21S 8/04* | (2006.01) |

(52) U.S. Cl.
CPC ..... *F21V 21/22* (2013.01); *F21V 21/005* (2013.01); *F21S 8/032* (2013.01); *F21S 8/033* (2013.01); *F21S 8/046* (2013.01); *F21Y 2103/10* (2016.08); *F21Y 2115/10* (2016.08)

(58) Field of Classification Search
CPC ..... F21V 21/005; F21V 21/22; F21V 17/02; F21V 15/012; F21V 21/34; F21S 28/032; F21S 8/033; F21S 8/046
USPC ..... 362/219
See application file for complete search history.

(56) References Cited

U.S. PATENT DOCUMENTS

| | | | | |
|---|---|---|---|---|
| 2,408,783 | A * | 10/1946 | Kloner | F21S 8/031 362/219 |
| 2,532,023 | A | 11/1950 | Guth | |
| 2,849,595 | A * | 8/1958 | Zurawski | F21V 21/02 362/219 |
| 3,673,402 | A | 6/1972 | Weiss | |
| 4,881,156 | A | 11/1989 | Shemitz | |
| 5,624,178 | A | 4/1997 | Lee | |
| 6,431,726 | B1 | 8/2002 | Barton | |
| 6,736,522 | B1 * | 5/2004 | Cini | F21S 2/00 362/145 |
| 7,036,955 | B2 | 5/2006 | Kazi | |
| 7,234,832 | B2 | 6/2007 | Lippis | |
| 8,152,331 | B1 | 4/2012 | Barton | |

(Continued)

*Primary Examiner* — Claude J Brown
(74) *Attorney, Agent, or Firm* — Metz Lewis Brodman Must O'Keefe LLC

(57) ABSTRACT

An adjustable light fixture and lighting system are selectively adjustable in the field and provide even light distribution across a space. A housing is selectively adjustable to a selected housing length and is mountable to the surface. A tray mountable to the housing includes plates which are selectively adjustable relative to one another to a selected tray length. Each plate includes a plurality of electroluminescent light sources providing uniformly luminous light across the light fixture. Overlap of plates varies the tray length and blocks light from light sources on one plate by the opposite plate. Evenly distributed light is therefore provided with no bright or dark spots. A lighting system of a plurality of light fixtures electrically connected to one another includes at least one adjustable light fixture, and preferably at least one stationary light fixture of fixed length. Methods of installation are also disclosed.

40 Claims, 15 Drawing Sheets

(56) References Cited

U.S. PATENT DOCUMENTS

2014/0063803 A1* 3/2014 Yaphe ..... F21V 15/012
362/247

* cited by examiner

ADJUSTABLE LIGHT FIXTURE AND LIGHTING SYSTEM

FIELD OF THE INVENTION

This invention relates to light fixtures and lighting systems, and more particularly, to light fixtures that provide uniform light distribution across a length of room, and can be adjusted in the field to accommodate different sized openings.

BACKGROUND

Lighting is a critical component of any interior space, such as commercial, office, retail and domestic space, and has been demonstrated to have an impact on productivity and mood. Designing lighting systems for illuminating an entire room or space can prove challenging, however, depending on the architecture of the room or building, ambient exterior light and other features. For instance, doorways, walls, electrical and pipe chases, air vents, structural support beams or columns, and other architectural elements in a room can restrict where light fixtures can be installed. Each room or space will have different dimensions and architectural elements with which to contend. Measurements specified in architectural drawings are not always translated to buildings once built, which may not be level or may have bowed, warped or misaligned walls, floors or other architectural components. These discrepancies can lead to further downstream miscalculations, which can prevent standard sized fixtures from fitting properly. In extreme cases, it can prevent a light fixture from being used altogether.

Smaller or discrete light fixtures are often employed in lighting systems, since they are less likely to be individually impacted by discrepancies in spacing and difficulties in lighting system design. However, this frequently means that the light fixtures are spaced apart to cover an entire room or area. Dead spots often exist in the space between light fixtures, and result in inconsistent or insufficient lighting. This can be particularly problematic at edges of a space, such as where the ceiling and wall meet, since ceiling-mounted light fixtures do not extend all the way to the wall.

Efforts have been made to address the need for flexibility in the field when installing light fixtures to suit a particular room, while also avoiding dark areas. For instance, U.S. Pat. No. 5,624,178 to Lee describes a light fixture with a telescoping housing for soffit downlighting applications. The housing is adjusted in the field to accommodate a particular sized opening, and a slide having a series of incandescent bulbs mounted thereto is fitted in the housing. The location of the slide within the housing can be changed to direct the light to particular areas. However, because the slide is movable within the housing, there is still space between the bulbs and the edges of the housing which can lead to dark spots.

U.S. Pat. No. 6,431,726 to Barton addresses the issue of dark areas between fluorescent bulbs. Specifically, two or more fluorescent lamp housings are positioned adjacent to one another at their respective terminal ends, such that an entire space can be covered and illuminated, and shadowing effects caused by spaces between the ends of lamps is avoided. However, Barton requires the use of standard sized fluorescent bulbs, which may not be suitable for every room. For instance, a room may not be divisible by the measure of the standard sized fluorescent bulb, resulting in space at the edges of the room where the fluorescent lamp housings of Barton would not fit. In addition, the adjacent fluorescent bulbs create bright spots where they align. This is the opposite of the dark areas previously addressed as an obstacle to be avoided, but overly bright areas can also be problematic. For instance, merely the change in luminosity across an area or room can cause the iris of the eye to have to constantly adjust to varying levels of brightness, leading to fatigue and strain. This can result from dark spots, bright spots or both.

Therefore, there still remains a need for providing consistent lighting across a room that can be accomplished in a custom manner to accommodate different rooms with different architectural needs.

SUMMARY OF THE INVENTION

An adjustable light fixture and lighting system is disclosed which provides even light distribution across an entire room, and is customizable in the field for a particular space. The adjustable light fixture includes a housing that is selectively adjustable in length to fit an opening in ceiling or wall, or target selected space on a surface. A tray carrying light sources is mounted to the housing, and is separately adjustable in length to correspond to that of the housing. The tray includes at least two plates, each having a plurality of electroluminescent light sources in a light array, such as a string of LEDs, which provides continuous uniform light along at least a portion of, and preferably the entire length of the tray, eliminating dark spots. The plates may be adjusted to create and/or vary an overlap region to alter the length of the tray. In so adjusting, one tray blocks the light emanating from the other tray in the overlap region. Accordingly, bright spots are also eliminated. Trim and lenses may be cut in the field to match the selected housing length and secured to the housing, to provide the desired aesthetic. The adjustable light fixture can be mounted in or to the surface, such as a wall, ceiling or even floor, in a flush, recessed, suspended or spaced configuration.

A lighting system is also disclosed which includes a plurality of light fixtures, at least one which is an adjustable light fixture. In a preferred embodiment, the lighting system also includes at least one stationary light fixture which has a fixed length. The light fixtures are electrically connected to adjacent fixtures, such as in a linear end-on-end fashion, to span across the space to be illuminated. Angled and curved light fixtures, which may be stationary or telescoping, are also contemplated to navigate corners, chases, columns and other structural anomalies of the room or space. The lighting system is therefore capable of providing wall-to-wall lighting coverage for a space in any direction for evenly distributed light. The various light fixtures may be the same or different lengths or sizes, and provide lighting of the same or different colors and intensities.

The adjustable light fixture and lighting system, together with their particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

As shown in the accompanying drawings, the present invention is directed to adjustable light fixture and lighting system which provides even light distribution across an entire room, and is customizable in the field for a particular sized opening. Even light distribution with no dark or bright spots across an entire space, such as from wall to wall, is possible with this invention, which utilizes end-on-end continuous lighting. The adjustable light fixtures of the present invention also provides a way to adjust the size of at least one unit to be sized to fit an opening, which may be smaller than a stationary light fixture and/or may be irregularly sized, such as one that does not correspond to blueprints for reasons such as warping of materials, and inaccuracies in measuring, cutting or installing other components in the room.

Figure 1A:
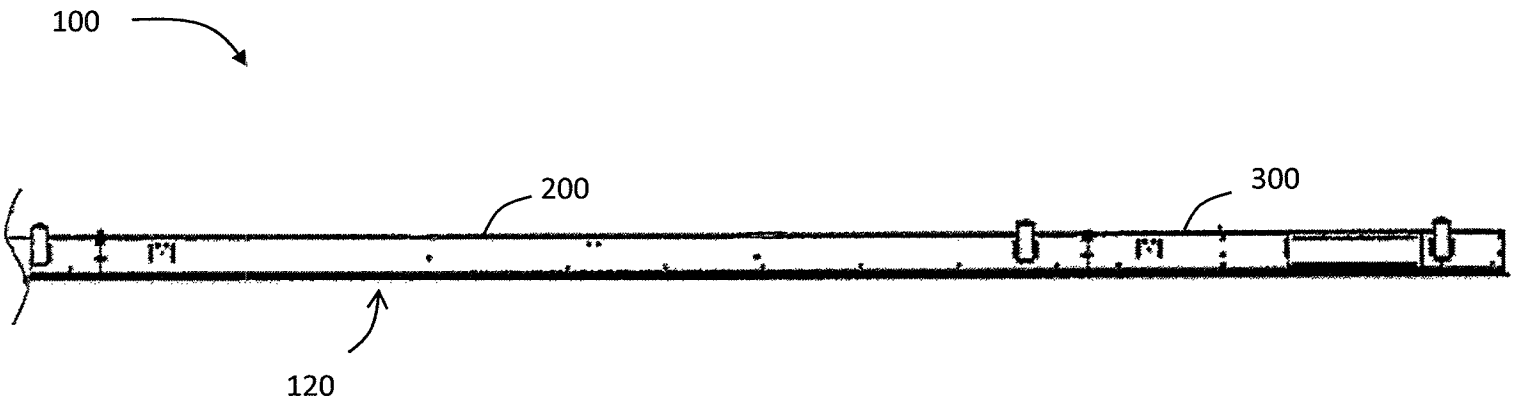
FIG. 1A is a plan view of the mounting side of one embodiment of the lighting system of the present invention.
Figure 1B:
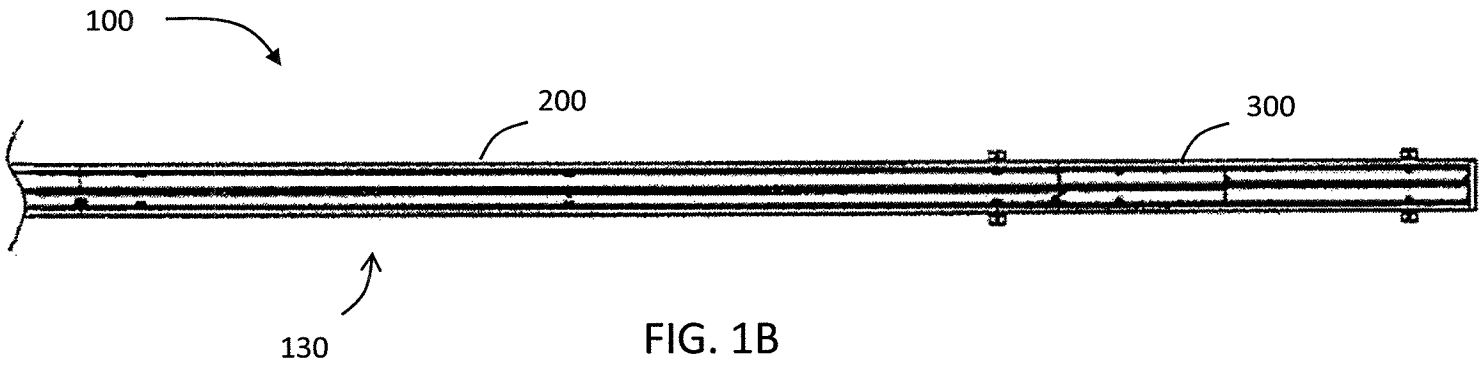
FIG. 1B is a plan view of the illuminating side of the lighting system of FIG. 1A.

The lighting system 100 of the present invention includes a plurality of light fixtures connected to each other, which may be connected end to end as shown in FIGS. 1A and 1B. In a preferred embodiment, the lighting system 100 spans the entire length of the space or room to be illuminated, such as from wall to wall. In some embodiments, the lighting system 100 may cover the entire distance of more than one wall, such as to navigate corners, and may even run a perimeter of the room for whole room lighting. FIG. 1A shows a mounting side 120 of the lighting system 100 that is configured to be mounted on, within or suspended from a surface, such as a ceiling, wall, or floor. The lighting system 100 can be installed as recessed within the surface so the lenses of the fixtures are flush with the surface; fixed behind the surface, such as bolted to the supporting structure of the surface; suspended from the supporting surface of the structure; and any other method of affixing the light fixtures within, on or from a surface. FIG. 1B shows an illuminating side 130 of the lighting system 100 that faces into the space to be illuminated and presents the lighting sources for illuminating the space.

In some embodiments of the lighting system 100, at least one stationary light fixture 200 having a fixed length is installed across a space of a room. Any number of stationary light fixtures 200 may be installed, preferably end-on-end, and connected to one another to span a length of a space to be illuminated. The various stationary light fixtures 200 may have the same fixed length, or may be different fixed lengths from one another. For example, each stationary light fixture 200 may measure up to 20 feet in length, and may be combined in any combination of numbers and lengths suitable to cover the space to be illuminated. In at least one embodiment, the stationary light fixture 200 may measure in the range of 1 to 12 feet in length. Other fixed lengths of various increments, such as fractions of an inch, are also contemplated herein. Further, the stationary light fixtures 200 may be linear; angled such as forming a right angle, acute or obtuse angle; curved; or curvilinear in shape to accommodate various design elements of a room, such as inner corners, outer corners, columns, electrical chases and HVAC ductwork.

Figure 2:
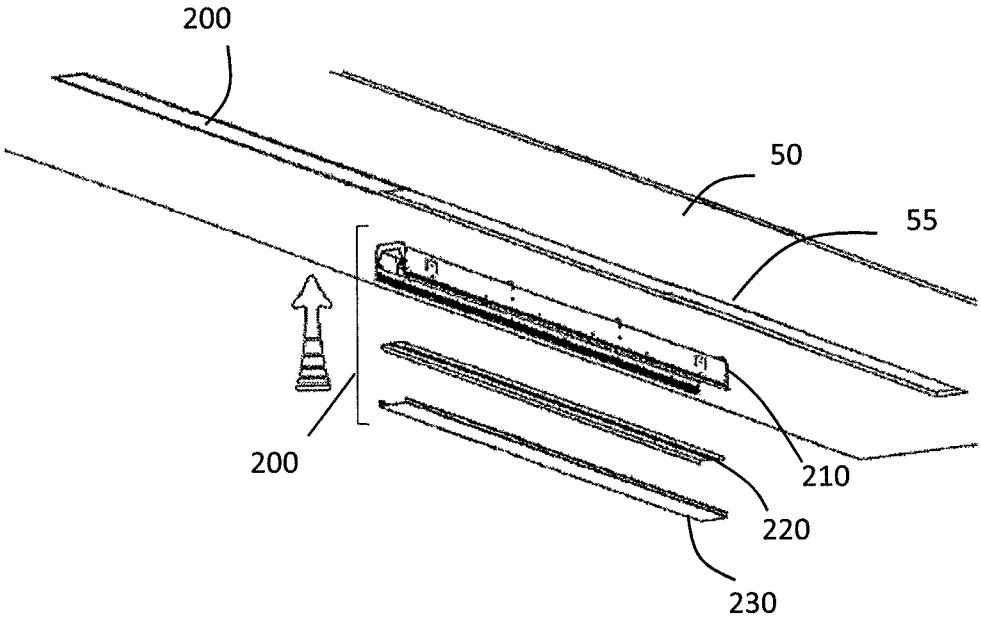
FIG. 2 is an isometric view of part of the lighting system of the present invention, showing a stationary light fixture in exploded view.
Figure 3:
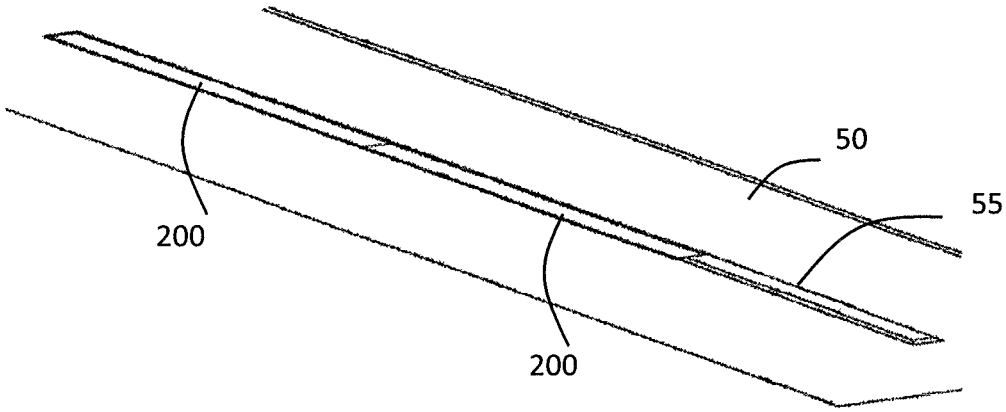
FIG. 3 is an isometric view of the lighting system of FIG. 2, showing the stationary light fixture installed.

In one example shown in FIG. 2, the stationary light fixtures 200 include a fixed housing 210 which is configured to fit within an opening 55 in the surface 50. The fixed housing may be made of any suitable material, such as steel, aluminum, or other metals or plastics. A tray 220 holding at least one light source, such as a light emitting diode (LED), is secured within the fixed housing 210 such that light emanating from the light source(s) is directed toward the room. The tray 220 may also be made of any suitable material, such as steel, aluminum, or other metals or plastics. Finally, in some embodiments a lens 230 may cover the illuminating side 130 of the stationary light fixtured 200. The lens 230 may be transparent or translucent, and allows light from the light source to pass through. The lens 230 may also be patterned, frosted, colored, or otherwise modified to change the appearance of the light filtering into the room. FIG. 3 shows two stationary light fixtures 200 installed end-on-end in a surface 50, and leaving an opening 55 of an irregular size. Such irregular sized openings 55 may occur from oddly shaped or dimensioned rooms, or if the dimensions of the room once built fails to match the blueprints, such as may result from mismeasurement, uneven or warped materials.

The lighting system 100 includes at least one adjustable light fixture 300, as seen in FIGS. 4-15. The adjustable light fixture 300 has telescoping features, as discussed in greater detail hereinafter, that permit the length of the adjustable light fixture 300 to be varied. Accordingly, the adjustable light fixture 300 is not fixed in length, but rather is selectively adjustable to accommodate a range of lengths along a predetermined continuum. The adjustable light fixture(s) 300 may also be of any form, such as linear; angled of any angle; curved; or curvilinear in shape to accommodate various design elements of a room, such as corners, columns, electrical chases and HVAC ductwork. In a preferred embodiment, the adjustable light fixture(s) 300 is linear. In other embodiments, the lighting system 100 is composed entirely of adjustable light fixtures 300 installed end on end and selectively adjustable, having no stationary light fixtures 200 included.

Figure 4:
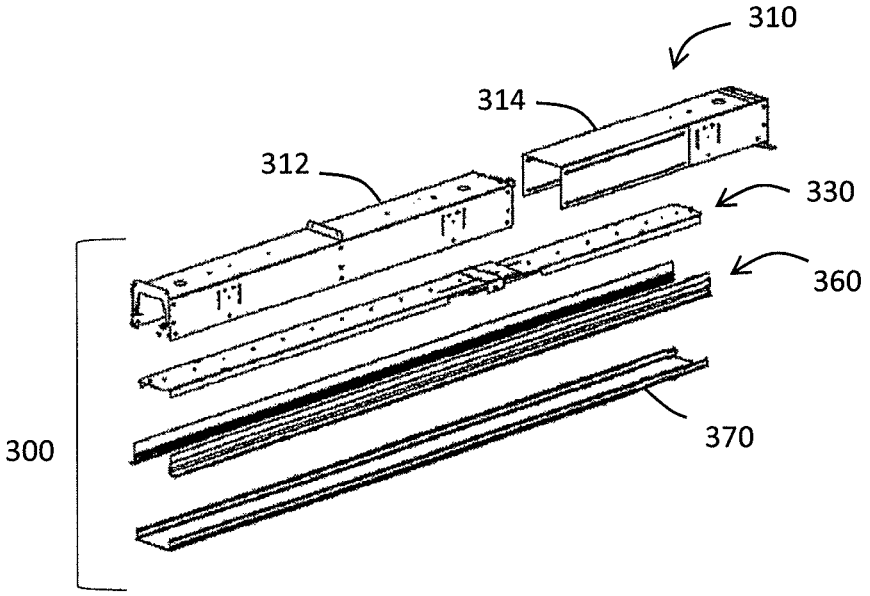
FIG. 4 shows an isometric exploded view of a first embodiment of the adjustable light fixture of the present invention.
Figure 5:
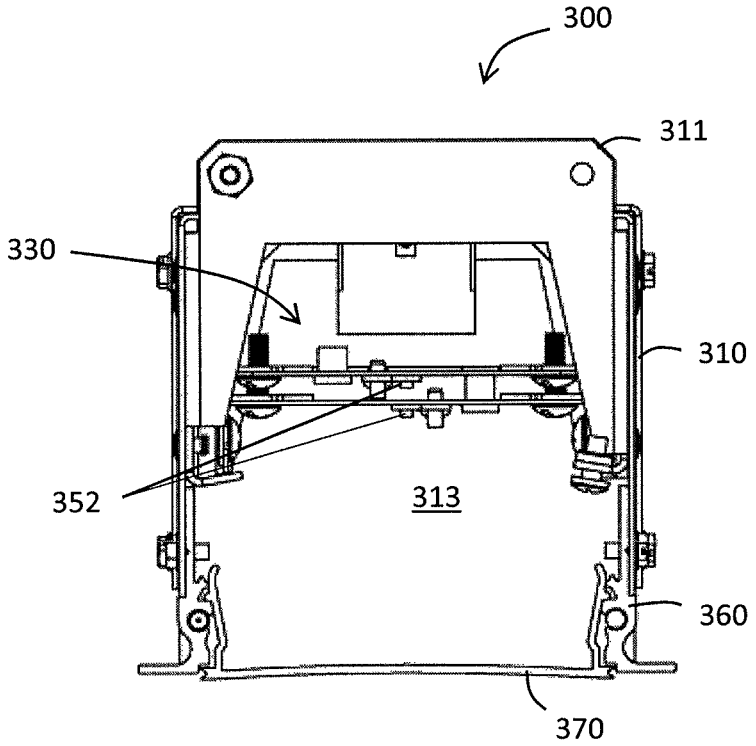
FIG. 5 shows a side end elevation view of the adjustable light fixture of FIG. 4 assembled.

As seen in FIGS. 4 and 5, the adjustable light fixture 300 of the present invention includes a housing 310, a tray 330, trim 360 and a lens 370. FIG. 4 shows these elements in exploded view, and FIG. 5 shows them assembled from the end side view.

The adjustable light fixture 300 includes a housing 310, such as depicted in FIGS. 4-8C, configured to be mounted to a surface 50 to secure the adjustable light fixture 300 in the lighting system 100. The housing 310 may be made of any suitable material, such as steel, aluminum, or other metals or plastics. The housing 310 also retains the tray 330 which holds the light sources, as discussed in greater below. Accordingly, in at least one embodiment the housing 310 includes a top 315 and at least one side 316 surface defining an exterior on one side and an opposite interior 313 space or cavity in which the tray 330 and light sources may be positioned. The height of the housing 310 defined between the top 315 and the opposite opening may be any suitable height to accommodate the tray 330 and light sources discussed hereinafter. For instance, in some embodiments, the housing 310 may have a height in the range of 0.5 to 20 inches. In certain embodiments, the housing 310 may have a height in the range of 1 to 5 inches. In still other embodiments, the height may be in the range of 3 to 4 inches. The housing 310 also has a length that extends between a first end 324 and opposite second end 326. In some embodiments, the housing 310 length may be up to 240 inches. In certain embodiments, the housing 310 length may be 10 to 48 inches and in still further embodiments may be 12 to 24 inches.

The housing 310 length is adjustable in a variety of ways. For instance, in some embodiments, as in FIGS. 4-8C, the housing 310 is made up of a first portion 312 and a separate second portion 314 that are configured to engage one another. The first and second portions 312, 314 may fit together telescopically, although in some embodiments they may simply be connected to one another. In still other embodiments, the first and second portions 312, 314 of the housing 310 are spaced apart from one another and need not be touching or connected to one another. Regardless of configuration, together the first and second portions 312, 314 collectively define the housing 310 and its length, such that the first portion 312 may include the first end 324, and the second portion 314 may include the second end 326. The first and second portions 312, 314 may have the same or substantially the same shape, configuration and dimension which, when assembled, define the housing 310. For example, the first and second portions 312, 314 may have the same length or different lengths. Further, each of the first and second portions 312, 314 may measure up to 240 inches in length. In some embodiments, each of the first and second portions 312, 314 may measure in the range of 12 to 192 inches. In certain embodiments, each of the first and second portions 312, 314 may measure in the range of 24 to 96 inches. In certain embodiments, each of the first and second portions 312, 314 may measure in the range of 12 to 24 inches.

The first and second portions 312, 314 are aligned along a housing axis and are selectively movable in relation to one another, such as slidably and/or in a telescoping fashion, along the housing axis to adjust at least one dimension of the housing 310, such as the length. As used herein, the terms "movable," "adjustable," and "variable" may be used interchangeably to indicate movement. The housing 310 is therefore selectively movable to change the dimensions of the housing 310 to a selected housing length or dimension. The selected housing length corresponds with the length of a desired location to mount the adjusting light fixture 200. For instance, the selected housing length may correspond to an irregularly sized opening 55 in a surface 50, such as one in which industry standard length light fixtures would not fit. In other embodiments, the selected housing length may correspond to the distance between the last light fixture in a lighting system 100 and the wall of the room or space to be illuminated. In still other embodiments, the selected housing length may correspond to a portion of the surface 50 to which the housing 310 will be mounted, such as for targeted lighting solutions. The selected housing length may correspond to a measured or pre-measured length, but in at least one embodiment measurement is not needed.

In at least one embodiment, the first and second portions 312, 314 are configured to slidably engage one another. In some instances, this slidable engagement may be telescopic. For instance, the second portion 314 may be slightly larger than the first portion 312 and slides over the first portion 312 during telescoping motion in the adjustment direction 400. In other embodiments, the second portion 314 may be slightly smaller than the first portion 312 and slides within the first portion 312 during telescoping motion in the adjustment direction 400. Regardless of whether the second portion 314 fits over or under the first portion 312, the sliding or telescoping action occurs along the housing axis in the adjustment direction 400.

Figure 6A:
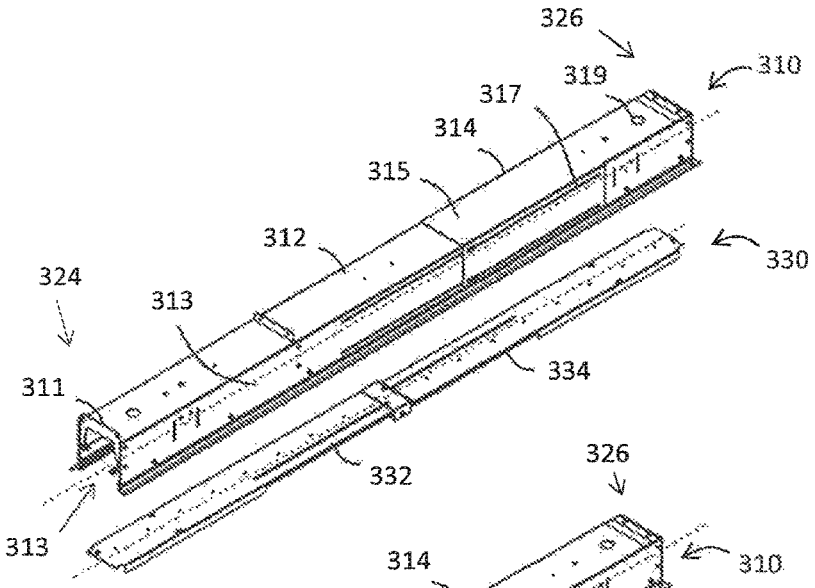
FIG. 6A shows an isometric exploded view of the housing and tray of the adjustable light fixture of FIG. 4 in an extended position.
Figure 6B:
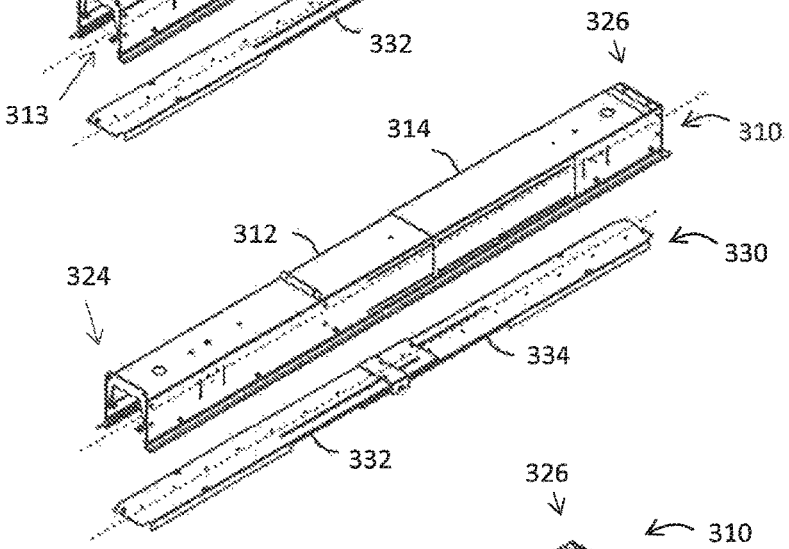
FIG. 6B shows the housing and tray of FIG. 6A in an intermediate position.
Figure 6C:
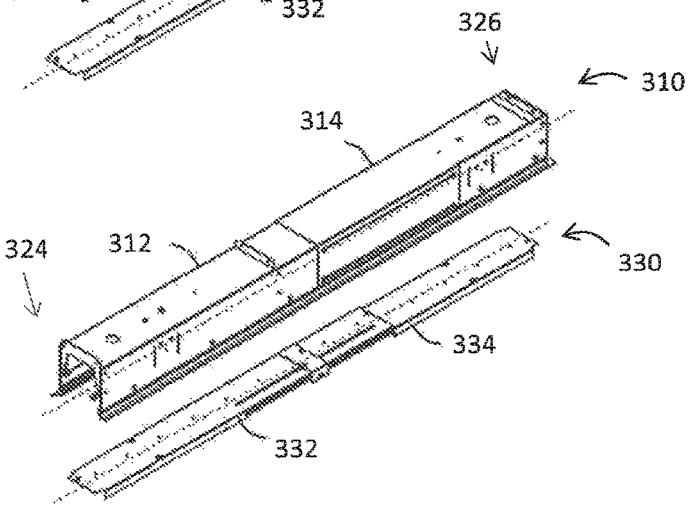
FIG. 6C shows the housing and tray of FIG. 6A in a collapsed position.
Figure 8A:
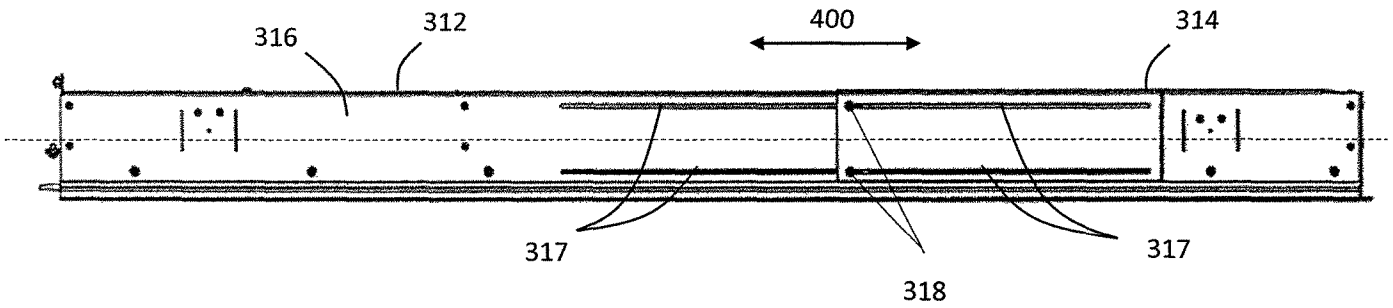
FIG. 8A shows a front side elevation of the housing of the adjustable light fixture of FIG. 4 in an extended position.
Figure 8B:
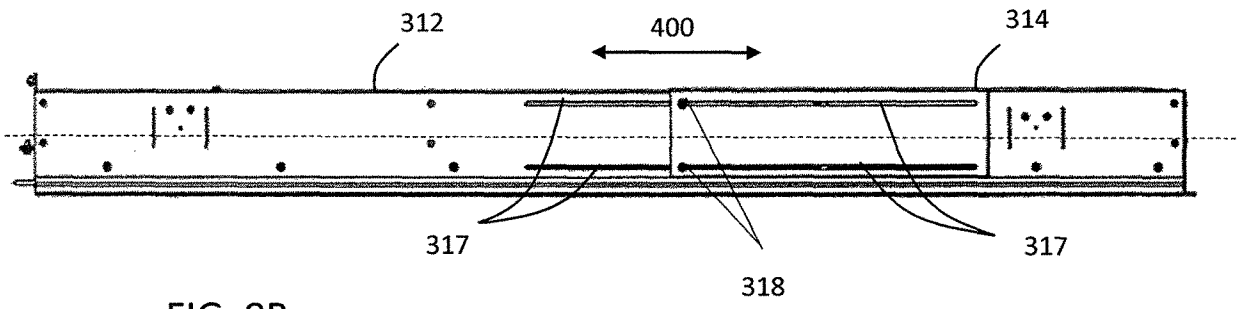
FIG. 8B shows a front side elevation of the housing of FIG. 8A in an intermediate position.
Figure 8C:
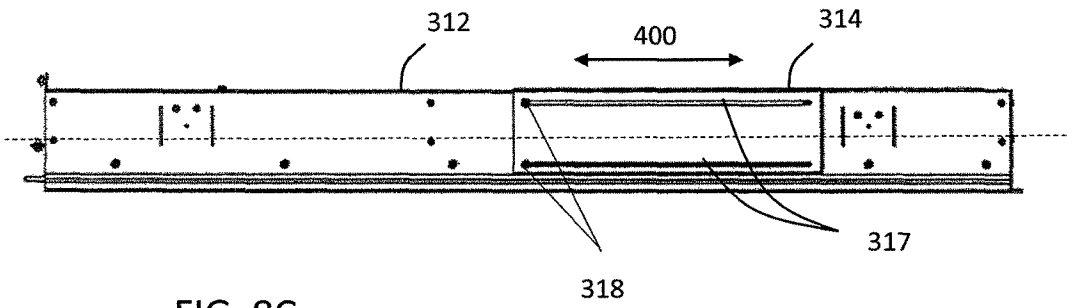
FIG. 8C shows a front side elevation of the housing of FIG. 8A in a collapsed position.

For instance, FIGS. 6A and 8A shows the housing 310 in an extended position, where the telescoping action in the adjustment direction 400 has been maximized while still overlapping to some degree. In this position, the minimal amount of overlap between the first and second portions 312, 314 of the housing 310 is achieved to secure the first and second portions 312, 314 together while still providing the longest housing possible 310 while still connected. Any further adjustment would require shortening the housing 310 length or separating the first and second portions 312, 314. FIGS. 6B and 8B show an intermediate length, where the first and second portions 312, 314 of the housing 310 are adjusted relative to one another to provide an overall length of the housing 310 that is of an intermediate amount of overlap. FIGS. 6C and 8C show the housing 310 in a collapsed or condensed position, where the overlap of the first and second portions 312, 314 is maximized to make the shortest length housing 310 possible given the lengths of portions 312, 314. In some embodiments, as depicted in FIGS. 6C and 8C, the first and second portions 312, 314 do not entirely overlap when fully collapsed down. In other embodiments, however, the first and second portions 312, 314 may overlap entirely when fully collapsed, such that the overlap is defined by the length of the first or second portions 312, 314. For instance, if the first and second portions 312, 314 each measure 40 inches in length, the maximum overlap may be 40 inches. It should be understood that the housing 310 may be adjustable along a continuum between extended and collapsed positions to provide any amount or increment of overlap, including no overlap, limited only by the length of the first and second portions 312, 314. For example, if the first and second portions 312, 314 each measure 40 inches in length, the overlap may be anywhere from 0 to 40 inches. In some embodiments, the overlap may be in the range of 1 to 50 inches, and in further examples may be in the range of 3 to 12 inches. The maximum amount of overlap is defined by the length of the first and second portions 312, 314. In embodiments where the first and second portions 312, 314 are not the same length, the maximum overlap region may be limited by length of the shorter portion.

It should also be appreciated that in some embodiments, the first and second portions 312, 314 may abut one another, engaging but not overlapping. In still other embodiments, the first and second portions 312, 314 need not engage with one another, but may be aligned along the housing axis and may be spaced apart from one another.

The housing 310 may also include a housing slot 317 disposed along a surface of the housing 310, such as along a side(s) 316. The housing slot 317 may be located on one or both the first and second portions 312, 314 of housing, and extends at least part of the length of the first and/or second portion 312, 314, up to and including the full length of the first and/or second portion 312, 314. At least one housing retention member 318 is retained within the housing slot 317, as shown in FIG. 7B and FIGS. 8A-8C. A length of the housing retention member 318 extends through the housing slot 317, at least during telescoping adjustment of the housing 310, and serves to keep the first and second portions 312, 314 in proximity to one another and from extending or collapsing beyond the limits of the housing slot 317. In some embodiments, the housing retention member 318 may be a screw or similar device that can be selectively tightened and loosened to selectively secure the first and second portions 312, 314 together when the desired length of the housing 310 is achieved. In other embodiments, the housing retention member 318 may be a rivet, pin, tab, bolt or other hardware that extends through the housing slot 317 and restricts at least one degree of movement, and preferably two degrees of movement, while permitting movement along the axis of the housing 310. The first and second portions 312, 314 of the housing 310 are held in place relative to one another by direct mounting to or from the surface 50 or other part of the adjustable light fixture 300, such as trim 360, by screws or other suitable mounting hardware.

When the desired position or length is achieved, the housing retention member 318 may be tightened, such as but not limited to by turning. In some embodiments, a distal end of the housing retention member 318 contacts the innermost portion of the housing 310 and provides frictional engagement of the surface of the innermost portion of the housing 310 as the housing retention member 318 is tightened, such that the position of the first and second portions 312, 314 is maintained by frictional force of the housing retention member 318 on the surface of the innermost portion 312, 314. In other embodiments, the innermost one of the first or second portions 312, 314 may include an opening positioned on a surface thereof, corresponding to the housing slot 317 of the outermost portion, and dimensioned to receive a distal end of the housing retention member 318. Turning the housing retention member 318 tightens the first and second portions 312, 314 together, such as by threading on the housing retention member 318 engaging an interior side of the opening. These are but a few illustrations. Other housing retention members 318 and methods of securing the first and second portions 312, 314 together once the desired length of housing 310 is achieved are contemplated herein. The engagement of the housing retention member 318 is also selectively reversible, such that the housing retention member 318 may be adjusted, such as by turning in an opposite direction, to loosen the connection of the first and second portions 312, 314, which enables further adjustment of the housing 310 length.

Figure 22:
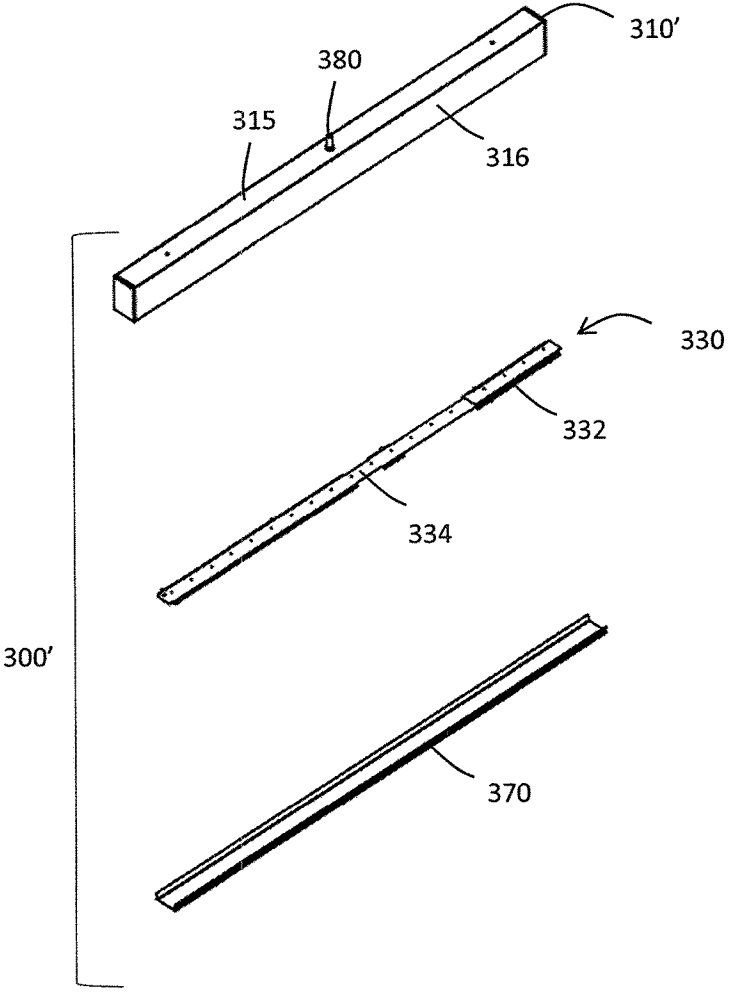
FIG. 22 is an isometric exploded view of a second embodiment of the adjustable light fixture of the present invention with a fixed housing.

In other embodiments of the adjustable light fixture 300', such as depicted in FIG. 22, the housing 310' may be a single unitary portion of a fixed length. The housing 310' length may be adjusted by cutting the housing 310' to a selected size, such as the size of the space remaining at the end of a run of light fixtures in the system 100, or the size of an opening 55 in the surface 50. The housing 310' may otherwise have the same features and dimensions as described above, including a top 315, sides 316 and a cavity 313 defined therein.

The housing 310 may also include a joining member 311, as depicted in FIGS. 4 and 5. The joining member 311 is configured to connect the adjustable light fixture 300 to an adjacent stationary light fixture 200 or adjustable light fixture 300 in the lighting system 100. In at least one embodiment, the joining member 311 is a flange extending from a surface of the housing 310, such as from the top 315 and/or sides 316 of the housing 310, as in FIG. 4. In other embodiments, the joining member 311 is a bracket, hinge, joint, adaptor or other joining device. The joining member 311 may be integrated and formed with the housing 310, or may be a separate component that is mounted on or otherwise secured to the housing 310, such as through soldering, welding, and fasteners such as screws, nuts and bolts, for instance. In a preferred embodiment, the joining member 311 is located on at least one end of the housing 310, such as a first end 324 as in FIGS. 4 and 7A, or second end 326. A terminal end location enables the housing 310 of the adjustable light fixture 300 to be connected linearly end-on-end to an adjacent light fixture 200, 300 in the lighting system.

Figure 7A:
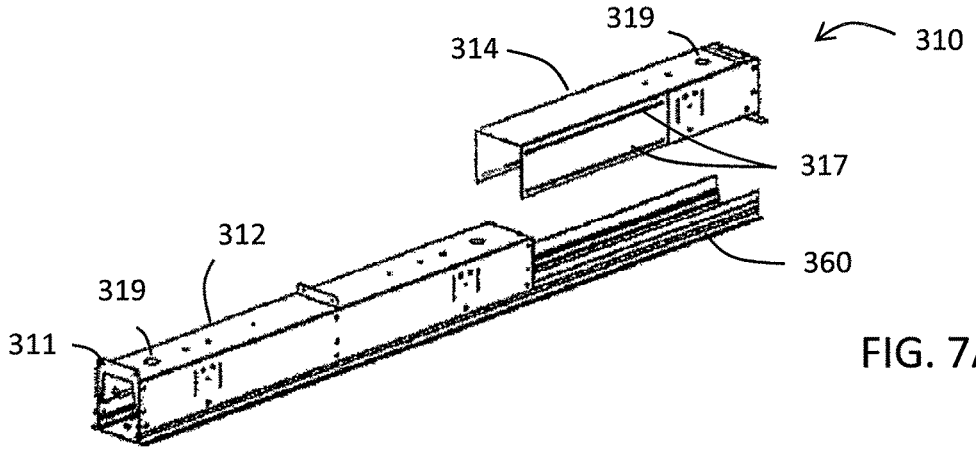
FIG. 7A shows a partial exploded isometric view of the housing and trim of the adjustable light fixture of FIG. 4.
Figure 7B:
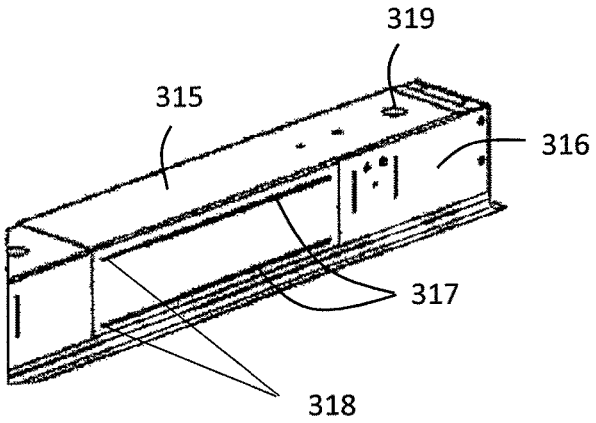
FIG. 7B shows the second portion of the housing of FIG. 7A connected to the first portion and trim.

The housing 310 may also include additional apertures 319 that are dimensioned to permit the passage of materials through the housing 310. For instance, as seen in FIGS. 4 and 7A-7B, the housing 310 may include at least one aperture 319 in the top 315 of the housing 310 through which electrical cables for the light sources can be passed (not shown) for connecting to the mains electrical power supply. The apertures 319 may have any suitable size and dimension to accommodate wires, cables, or other components that span between the interior 313 and exterior 320 of the housing 310.

The adjustable light fixture 300, 300' also includes an adjustable tray 330 having at least one light source, as described in greater detail below. In some embodiments, the tray 330 is mountable to the housing 310, 310', such as secured within the cavity 313 as shown in FIGS. 4 and 5. In other embodiments, the tray 330 may be secured to the edge of the cavity 313 of the housing 310, 310', or to various surfaces 315, 316 of the housing 310, 310'. In still further embodiments, a housing 310, 310' is not required in the adjustable light fixture 300, and the tray 300 may be mountable directly to the surface 50 of the space to be illuminated.

The tray 330 includes multiple plates that collectively define the tray 330 and are selectively adjustable relative to one another to vary the length of the tray 330. Any number, size and arrangements of plates is contemplated to make up the tray 330. For example, in at least one embodiment as shown in FIGS. 6A-6C and 10A-10C, the tray 330 includes a first plate 332 and a second plate 334. For ease of reference, first and second plates 332, 334 will be described as an illustrative example, although it should be appreciated that the same descriptions apply to any pair of adjacent plates along a tray 330.

The plates 332, 334 are selectively engageable with one another, and may be positioned adjacent to one another, such as abutting one another, and may also engage one another. For instance, in some embodiments the first and second plates 332, 334 may be positioned in at least partially overlapping relation to one another, defining an overlap region 338, as in FIGS. 10A-10C. A flange 339 or other reinforcing structure may extend from the surface of the first and second plates 332, 334 to provide rigidity to the plates.

Figure 10A:
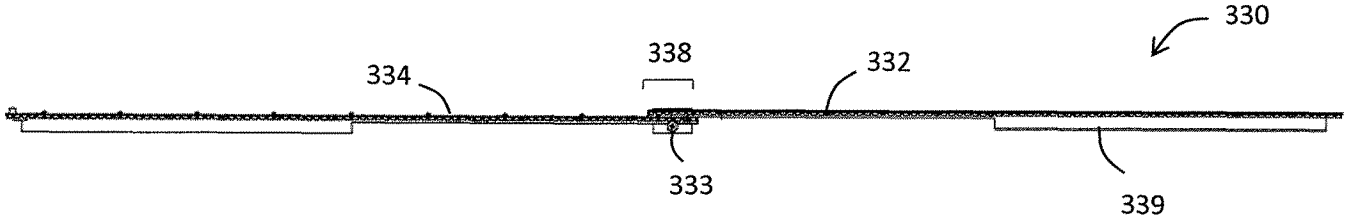
FIG. 10A shows a front elevation view of the tray of the adjustable light fixture of the present invention in an extended position.
Figure 10B:
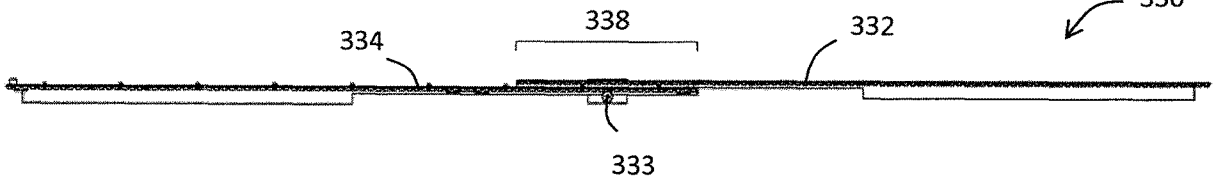
FIG. 10B shows a front elevation view of the tray of FIG. 11A in an intermediate position.
Figure 10C:
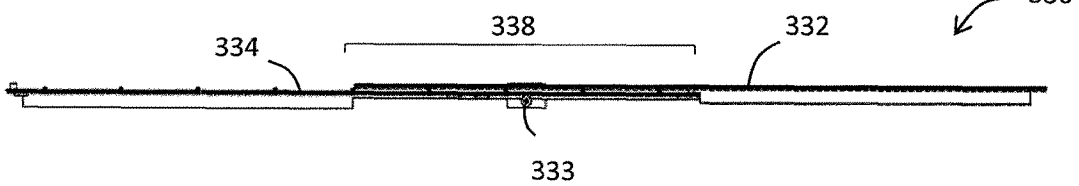
FIG. 10C shows a front elevation view of the tray of FIG. 11A in a condensed position.

The first and second plates 332, 334 are selectively movable or adjustable relative to one another along a tray axis in an adjustment direction 400 to lengthen or shorten the tray 330, as demonstrated in FIGS. 6A-6C, 10A-10C and 12A-12C. With particular reference to FIGS. 10A-10C, lengthening of the tray 330 results in a smaller overlap region 338, and conversely, shortening the tray 330 results in a longer overlap region 338. In at least one embodiment, the first and second plates 332, 334 are slidably engageable and adjustable in relation to one another where the first and second plates 332, 334 slide over/under one another. In some embodiments, the first and second plates 332, 334 may be telescopically adjustable or moveable in relation to one another. Accordingly, the tray 330 is adjustable to a selected tray length, which preferably corresponds to the selected length of the housing 310. The tray 330 may be adjusted to be the same length as the housing 310, 310' or may be slightly shorter than the housing 310, 310' so as to fit within the interior of the housing 310, 310'. For example, in at least one embodiment, the tray 330 may be up to 20 feet in length. In another embodiment, the tray 330 may be up to 10 feet in length. In addition, each of the various plates 332, 334 making up the tray 330 may be the same or different lengths from one another. In at least one embodiment, individual plates 332, 334 may up to 10 feet in length. In some embodiments, individual plates 332, 334 may be in the range of 1-8 feet in length, and in further embodiments may be in the range of 1-2 feet in length. Both the housing 310 and tray 330 may be adjusted in the field to a selected size, which may correspond to an opening 55 or a particular space or region of the surface 50, rather than having to rely on ordering pre-selected sizes that may not fit. In embodiments having more than two plates comprising a tray 330, each set of adjacent plates may be positioned in abutting relation to one another or may define an overlap region 338 as defined above. Each sets of adjacent plates may be set in its own configuration independently of other sets of adjacent plates, even ones which share a common plate.

In some embodiments, the tray 330 and housing 310 may be simultaneously adjustable together, such as where sections of the adjustable light fixture comprise a first portion 312 of the housing 310 and a first plate 332 of the tray 330, as one section, and the second portion 314 of the housing 310 and second plate 334 of the tray 330, as another section, are moved collectively as sections relative to one another to adjust the length of the adjustable light fixture 300. In other embodiments, however, the plates 332, 334 of the tray 330 may be movable or adjustable separately from the portions 312, 314 of the housing 310. Accordingly, the tray 330 and housing 310 may be independently adjusted to selected lengths. In certain embodiments, however, the housing 310' may be of a fixed length, which may be permanently altered to a selected length as described above. In such embodiments, the tray 330 is separately adjustable from the housing 310', but can be adjusted to correspond to the selected length of the housing 310' once determined.

Figure 12A:
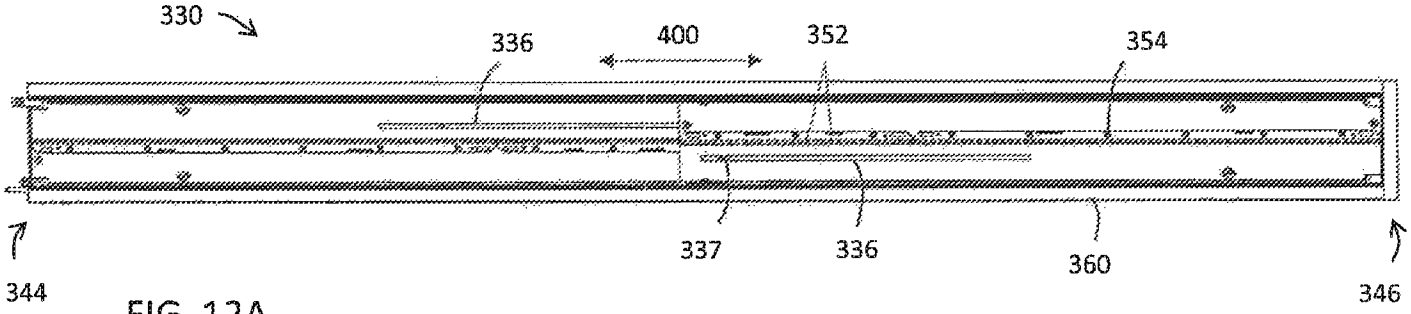
FIG. 12A shows a plan view of the tray of the adjustable light fixture from the illuminating side, shown in an extended position.
Figure 12B:
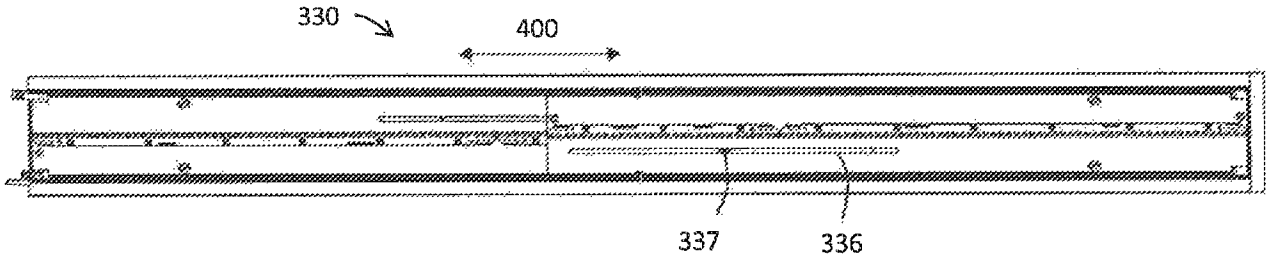
FIG. 12B shows a plan view of the tray of FIG. 10A in an intermediate position.
Figure 12C:
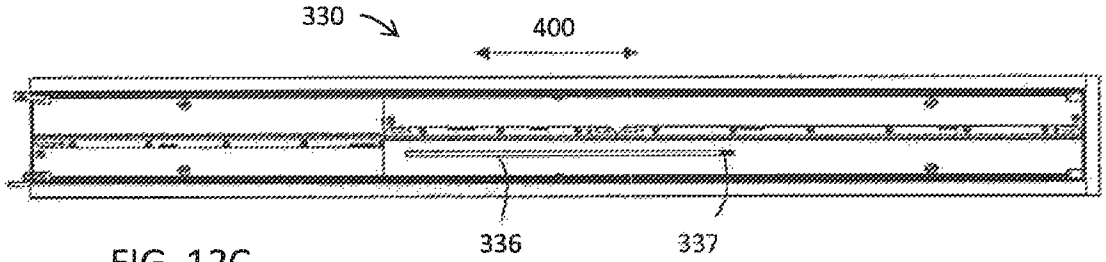
FIG. 12C shows a plan view of the tray of FIG. 10A in a condensed position.

In some embodiments, such as shown in FIGS. 12A-12C, the tray 330 may include a tray slot 336 along at least a portion of its length to facilitate adjustment of the tray 330. In at least one embodiment, at least one of the first and second plates 332, 334 may include tray slots 336. Preferably, each of the first and second plates 332, 334 includes a tray slot 336. The tray slot 336 may be a longitudinal aperture in the tray 330, as shown in FIGS. 12A-12C, or may be a plurality of separate apertures spaced along a length of the tray 330. In at least one embodiment, a stop member 337 extends transversely through the tray slot 336 and prevents the first and second plates 332, 334 from being extended in the adjustment direction 400 beyond the point of the stop member 337, and therefore from being separated from one another. In the opposite direction, the stop member 337 limits the degree to which the first and second plates 332, 334 can be collapsed or overlapped. Accordingly, the tray slot 336 and stop member 337 collectively align and define the outer limits of movement in the adjustment direction 400 of the first and second plates 332, 334 in expanding and collapsing. The stop member 337 may be a screw, bolt, bushing, or similar elongate piece that can be selectively positioned along the tray slot 336. The stop member 337 may have threading or other similar features that permit it to be tightened down to the tray 330 adjacent to the tray slot 336 when the desired position is reached. Accordingly, the outer limits of the movement of the first and second plates 332, 334 may also be adjustable. The stop member 337 may extend from the first plate 332 through the tray slot 336 on the second plate 334, thus adjustably connecting the two trays together and keeping them aligned with one another. In other embodiments, the stop member 337 extends just far enough through the tray slot 336 on the first or second plate 332, 334 to restrict the movement of the other tray without being secured to the other tray. In still other embodiments, the first and second plates 332, 334 may not be overlapped, but their respective ends may abut one another such that they engage one another in an end-on-end fashion. In other embodiments, the first and second plates 332, 334 may be spaced apart from one another so they do not engage but still collectively provide uniform light across the tray 330. In these embodiments, there may be no stop member 337 present, or it may be removed.

Figure 9A:
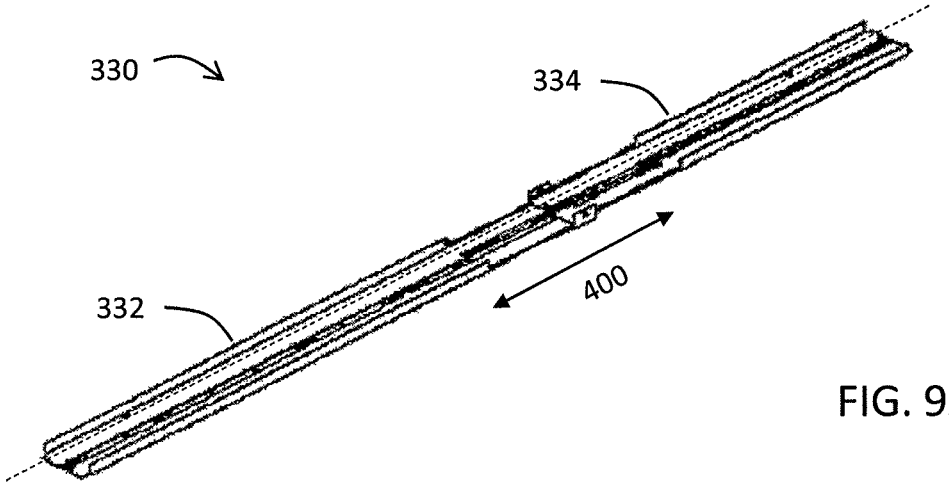
FIG. 9A shows an isometric view of the tray of the adjustable light fixture of the present invention.
Figure 9B:
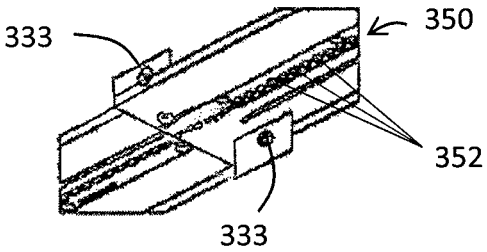
FIG. 9B shows a close-up of the overlap region of the tray of FIG. 9A.

The tray 330 also includes a tray retention member 333, best shown in FIG. 9B, which retains the first and second plates 332, 334 in position once the desired length of the tray 330 is established. The tray retention member 333 may be a screw, bolt, or other similar piece of hardware capable of being selectively tightened to secure the first and second plates 332, 334 together. In a preferred embodiment, as in FIGS. 9B-10C, the tray retention member 333 is located at the overlap region 338 of the tray 330 to easily affix the first and second plates 332, 334 together when the desired length and overlap is achieved. A bracket or other hardware may be utilized to facilitate the tray retention member 333. Although shown in connection with a bracket in the center of the overlap region 338, the tray retention member 333 may be located anywhere along the tray 330 as permits connection of the first and second plates 332, 334.

The tray 330 also includes a light array 350 having a plurality of electroluminescent light sources 352 that provide illumination for the adjustable light fixture 300. Referring to FIGS. 9B and 11-13C, the light array 350 may be a set of light sources 352, where each light source 352 is individual. The light sources 352 may preferably be electroluminescent light sources, such as light emitting diodes (LEDs). As used herein, "electroluminescent" means light emitted from the passage of an electrical current, and is distinct from fluorescence and incandescence. The light sources 352 may be configured to emit light at any wavelength in the visible light spectrum, although wavelengths in the infrared and ultraviolet portions of the light spectrum are also contemplated herein. The light sources 352 may therefore produce light of any color and luminosity, depending on the wavelengths and electrical energy supplied thereto. For example, in at least one embodiment, the light sources 352 are configured to emanate up to 1000 lumens of light, and in a preferred embodiment up to 150 lumens. In at least one embodiment, the light array 350 is a continuous strand of light sources 352, such as a string of LEDs positioned along the length of the tray 330 from a first end 344 to an opposite second end 346 thereof, shown in FIGS. 12A-12C. Accordingly, while at least a portion of the length of the tray 330 includes light sources 352, preferably the entire length of the tray 330 includes light sources 352. Any distribution or spacing of the light sources 352 along the tray 330 is contemplated, although an even distribution is preferable where the various light sources 352 are each separated by the same distance from adjacent light sources 352.

As used herein, the terms "even" and "uniform" may be used interchangeably to mean consistency, both in terms of spacing between light sources 352 and the quality of light emanating from the light sources 352 when viewed collectively from one light fixture 200, 300 to the next adjacent light fixture 200,300. For instance, the light sources 352 within the array 350 may be spaced millimeters or centimeters apart, and may preferably be spaced the same distance apart. In some embodiments, the light sources 352 are spaced so that light emanating from each light source 352 will blend with the light emanating from the adjacent light source(s) 352 to form a uniform or even distribution of light along the tray 330. In some embodiments, even light distribution is achieved by a variance of no more than 5% in the luminosity of the light between adjacent light sources 352. Accordingly, no dark spots (such as shadows corresponding to empty space between light sources 352) and no bright spots (such as from multiple light sources 352 spaced more closely together compared to other groupings of light sources) are present in the light emanating from the adjustable light fixture 300. In some embodiments, the light sources 352 are selectively dimmable, to adjust the luminosity of the light sources 352. Such adjustment affects all the plurality of light sources 352 simultaneously and to the same degree, so that the relative variance in luminosity between light sources 352 remains within the acceptable parameters to maintain uniform and even lighting throughout the entire system.

Figure 11:
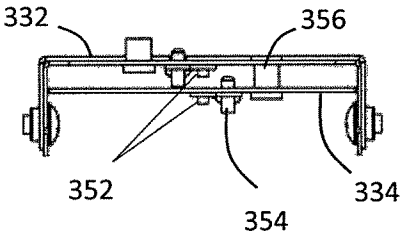
FIG. 11 is an elevation view of one end of the tray of the adjustable light fixture of the present invention.
Figure 13A:
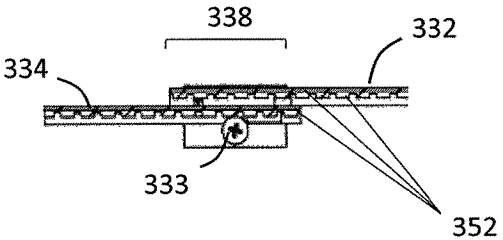
FIG. 13A shows a front elevation view of a close-up of the overlap region of the tray from FIG. 10A.
Figure 13B:
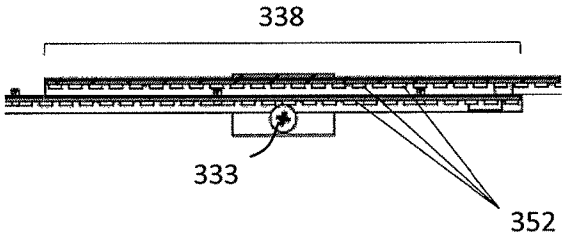
FIG. 13B shows a front elevation view of a close-up of the overlap region of the tray from FIG. 10B.
Figure 13C:
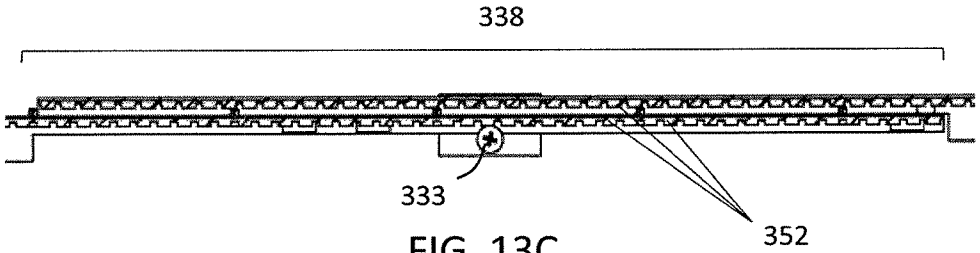
FIG. 13C shows a front elevation view of a close-up of the overlap region of the tray from FIG. 10C.

In at least one embodiment, as shown in FIGS. 11-13C, each of the first and second plates 332, 334 of the tray 330 includes a light array 350. With particular reference to FIGS. 12A-12C, the light array 350 on the first plate 332 may be aligned with and correspond to the light array 350 on the second plate 334 such that a continuous light array 350 extends from the first end 344 to the second end 346 of the tray 330. The light arrays 350 may be secured to the first and second plates 332, 334, such as with fasteners like screws, glue, welding, soldering, and other methods of permanently or reversibly affixing. FIG. 11 shows an example where screw-type fasteners 354 are used to secure the light arrays 350 to respective first and second plates 332, 334. The light arrays 350 are secured to like sides of the trays 332, 334 so that the light sources 352 are positioned along the same side of the tray 330. The tray 330 is installed at the housing 310, such as in the interior 313 of the housing 310 as depicted in FIG. 5, and is positioned with the light sources 352 facing away from the housing 310.

The tray 330 may also include at least one spacer 356 secured to or extending through the first or second plate 332, 334, as shown in FIG. 11. The spacer 356 extends away from the surface of the tray 332, 334 by a distance greater than the height of the light source(s) 352 and any fasteners 354 affixing the light array 350. The spacer(s) 356 limits the distance between the first and second plates 332, 334 in the overlap region 338 of the tray 330, and prevents the light arrays 350 and their components from scraping along the other tray 332, 334 during adjustment of the tray 330. In some embodiments, the spacer(s) 356 may be bushings or bearings, and may be made of any suitable material such as durable plastics, metals, or metal alloys.

The first and second plates 332, 334 are selectively movable relative to one another to adjust the length of the tray 330. This may result in creating or varying the overlap region 338, as seen in FIGS. 10A-10C and 13A-13B. Because the light sources 352 of the light array 350 are oriented on like sides of the first and second plates 332, 334, they direct light in a common light direction. In the overlap region 338, one tray blocks and obscures the illumination from the light sources 352 on the other tray. For instance, in FIGS. 13A and 13B, the second plate 334 blocks the light sources 352 on the first plate 332 in the overlap region 338 of the tray 330. The opposite configuration may also be made in certain embodiments, such that the first plate 332 blocks or obscures the light emanating from the second plate 334. Accordingly, there are no bright spots along the adjustable light fixture 300. An even light distribution is achieved with the overlapped plates 332, 334 of the tray 330. Similarly, since the light array 350 is provided along the length of the tray 330, as shown in FIGS. 12A-12C, there are no dark spots lacking illumination along the adjustable light fixture 300.

In some embodiments, the tray 330 has more than two plates, and adjacent plates are selectively movable relative to one another to adjust the length of the tray 330 and may overlap with one another to create multiple overlap regions 338 along the length of the tray 330. Each overlap region 338 blocks or obscures light from one plate by another adjacent overlapping plate. The multiple plates may overlap in alternating fashion, with a first plate 332 disposed closer to the housing 310, a second plate 334 disposed further from the housing 310 and closer to the area being illuminated, a third plate 333 disposed closer to the housing 310 and so on. In other embodiments, the multiple plates may overlap in consecutive fashion, with a first plate 332 disposed closer to the housing 310, a second plate 334 disposed further from the housing 310 and closer to the area being illuminated, and each successive plate disposed further from the housing 310 and closer to the area being illuminated than the preceding plate. Any combination of overlapping patterns of the various plates 332, 334, 333, etc. may be provided within a tray 330. In such embodiments having multiple plates within a tray 330, the overlapping regions 338 at adjacent Overlapping first and second plates 332, 334 with affixed light sources 352 in this manner has not been done before. Fluorescent bulbs and incandescent bulbs can be large or bulky, making overlap other than side-by-side adjacent overlap difficult logistically. Such a configuration would protrude extensively into the structure of the surface 50, such as the support beams and grids within a ceiling or the studs of a wall. Electroluminescent light sources 352 such as LEDs are more compact in size and permit greater flexibility in use. Furthermore, fluorescent and incandescent bulbs generate heat when in use. Overlapping such bulbs directly, rather than merely adjacent positioning, would increase the heat generation to a degree that is too high to be feasible for long- term lighting solutions. Electroluminescent light sources 352 such as LEDs do not generate heat, at least to the same degree, that fluorescent and incandescent bulbs do, thereby permitting direct overlap. However, even disregarding the heat issue, direct overlapping of fluorescent or incandescent bulbs would still result in the light emanating from one bulb flowing over and around the other bulb. The light from both bulbs would be visible and additive, creating a bright spot. The overlapping plates 332, 334 here provide blocking or obscuring cover to some of the light sources 352 in the tray 330. This results in no greater amount of light emanating from the light fixture, even when plates 332, 334 are overlapping.

Figure 14:
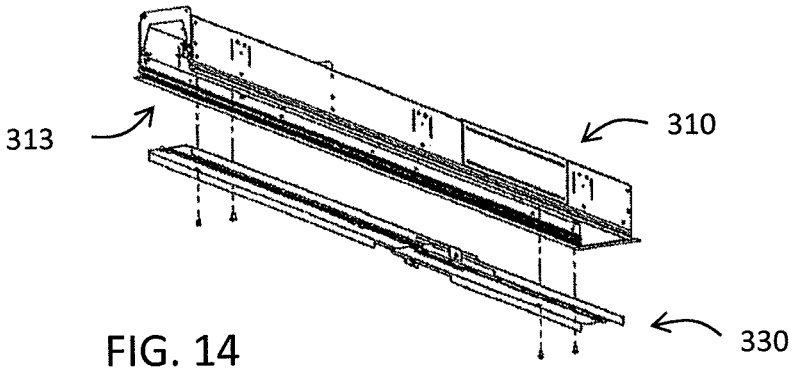
FIG. 14 is an isometric exploded view of an embodiment of the tray and housing of the adjustable light fixture of the present invention.
Figure 15:
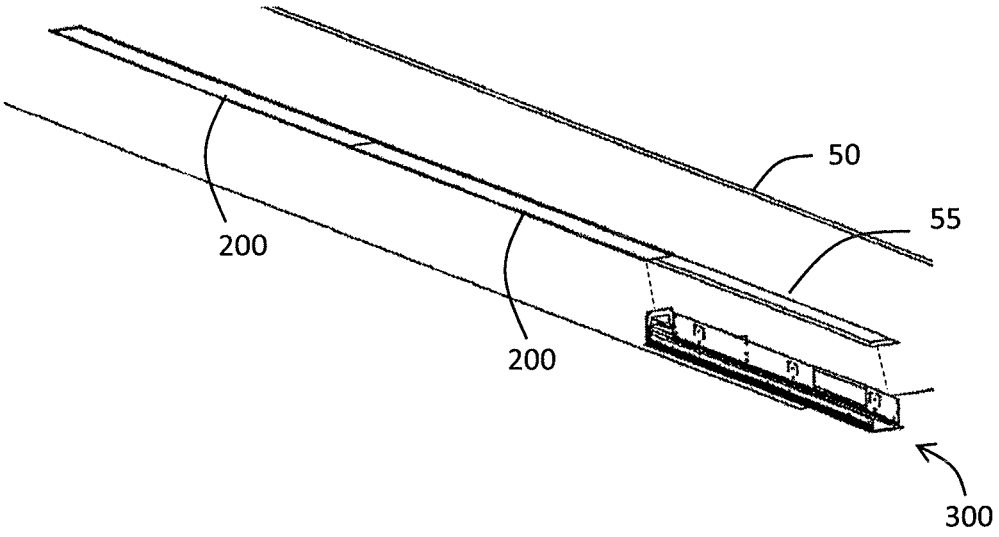
FIG. 15 is an isometric view of one embodiment of the lighting system of the present invention showing the adjustable light fixture being installed.

As depicted in FIG. 14, the tray 330 may be inserted into and secured within the interior 313 of the housing 310, with the light sources 352 facing away from the housing 310. In other embodiments, the tray 330 is mounted to the housing 310, 310', such as at the opening of the interior 313 or to one of the exterior surfaces 315, 316 of the housing. The housing 310, 310' may then be secured to the surface 50, such as at the preselected space, which may be an opening 55 in the surface 50 as in FIG. 15. Of course, in some embodiments the housing 310, 310' may be mounted to the surface 50 prior to insertion and mounting of the tray 330. As mentioned previously, the surface 50 may be a ceiling, wall, or floor of a room or other space to be illuminated. The housing 310, 310' may be mounted to the surface 50 to achieve a finished adjustable light fixture 300 that is flush with the surface 50, recessed in the surface 50, or is spaced apart from the surface 50 by a selected distance such as hanging or suspended into the room from the surface 50. Moreover, the housing 310, 310' may be secured to the surface with the light sources 352 facing away from the housing 310, 310' and either toward the room, such as for direct lighting, or away from the room, such as for indirect lighting.

Figure 19:
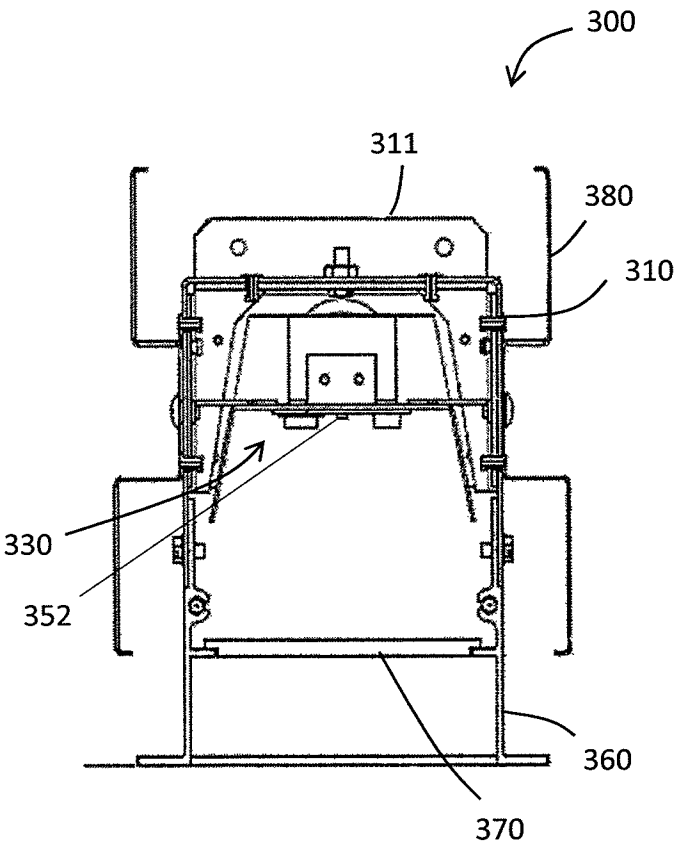
FIG. 19 is an end side elevation view of another embodiment of a lighting fixture showing another bolt slot grid mounting member.
Figure 18:
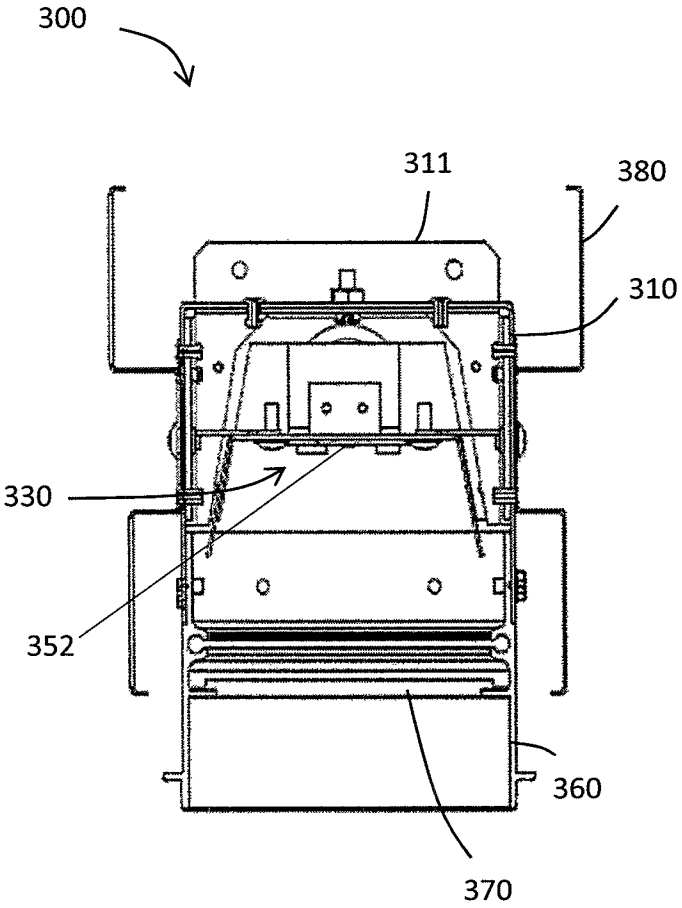
FIG. 18 is an end side elevation view of one embodiment of a lighting fixture showing a bolt slot grid mounting member.
Figure 21:
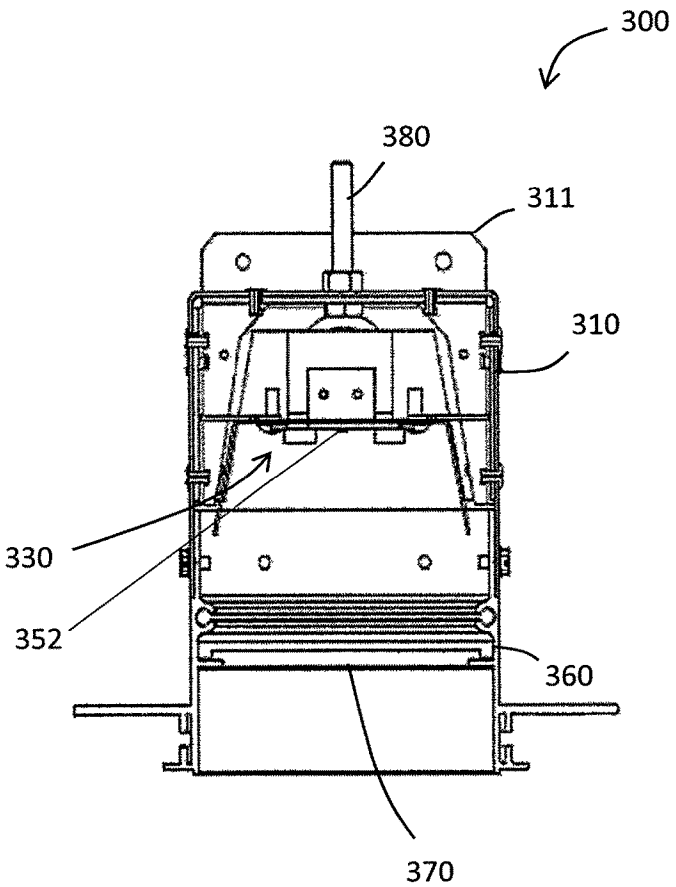
FIG. 21 is an end side elevation view of one embodiment of a lighting fixture showing a mounting member for flange-free mounting.
Figure 20:
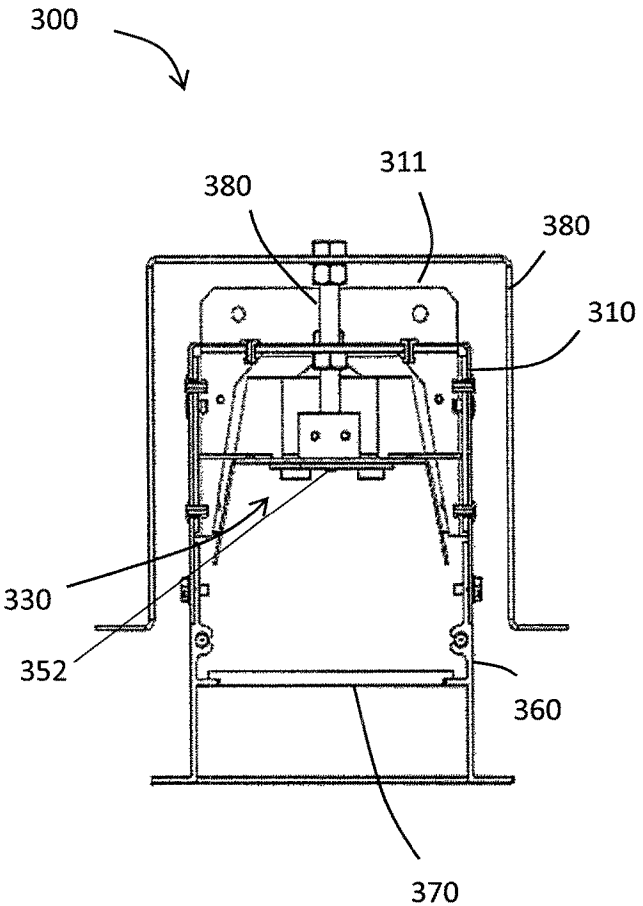
FIG. 20 is an end side elevation view of one embodiment of a lighting fixture showing a mounting member for overlap flange.
Figure 23:
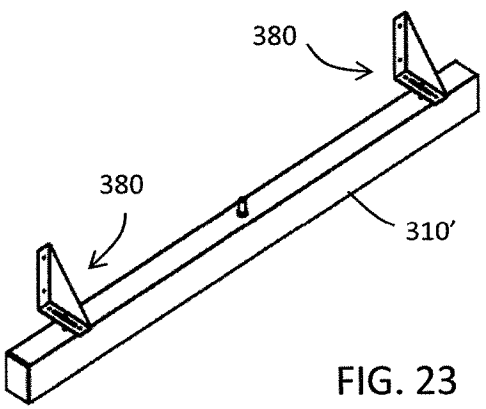
FIG. 23 is the assembled adjustable light fixture of FIG. 22, with additional mounting hardware.
Figure 24:
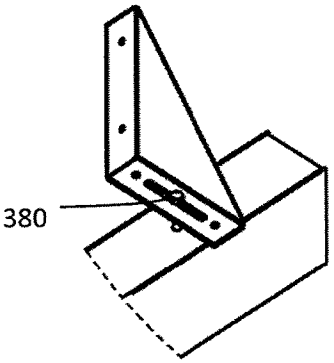
FIG. 24 is a detail view of one end of the adjustable light fixture and mounting hardware of FIG. 23.

The housing 310, 310' may be mounted to the surface 50 with a mounting member 380. In some embodiments, the mounting member 380 may be a bracket, such as shown in FIGS. 18 and 19 which depict mounting arrangements for a bolt slot grid. In other embodiments, the mounting member 380 may be a bolt, such as in flange-free mounting arrangements as in FIG. 21 or as in a pendant for suspension as in FIG. 22. In still other embodiments, the mounting member 380 may be a combination of bolt and bracket, as in overlap flange mounting of FIG. 20 or the pendant of FIGS. 23 and 24. In further embodiments, the mounting member 380 may be a suspension wire (not shown) which may connect the housing 310 to the structural framework of or behind the wall or ceiling. The mounting member 380 may be any hardware capable of securing the housing 310 to the surface or structural supports thereof. Such mounting member 380 may be used to secure the housing 310, 310' of the adjustable light fixture 300, 300' to the housing 210 of a stationary light fixture 200 or the housing 310, 310' of another adjustable light fixture 300, 300'.

Figure 16:
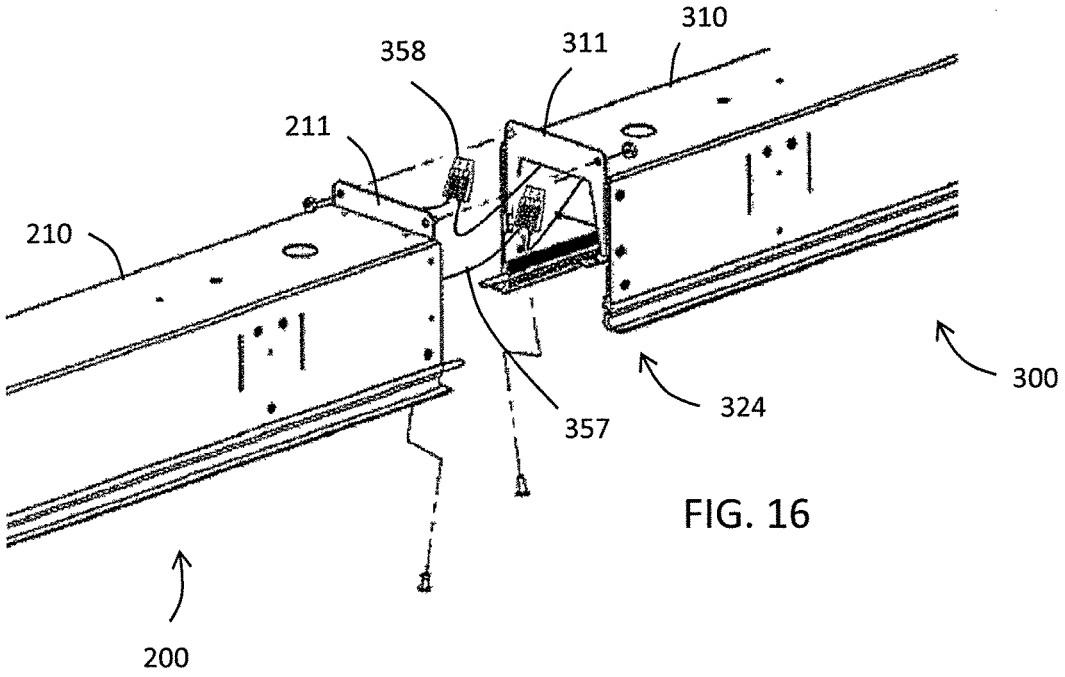
FIG. 16 is an isometric exploded partial view of adjacent light fixtures being joined end-on-end.

Once affixed to the surface 50, the adjustable light fixture 300, 300' is connected to adjacent light fixture(s) in the lighting system 100, which may be stationary light fixtures 200 or adjustable light fixtures 300, 300'. For instance, referring to FIG. 16, the adjustable light fixture 300 may be linearly positioned end-to-end with an adjacent light fixture, such that the first end 324 of the adjustable light fixture 300 is oriented adjacent to the nearest end of a stationary light fixture 200.

Figure 17:
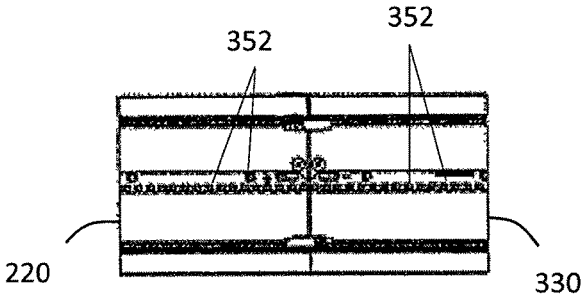
FIG. 17 is a plan view of the lighting side adjacent connected light fixtures.

The adjustable light fixture 300 and adjacent light fixture 200, 300, 300' are electrically connected, such as by connecting the light sources 352 or light arrays 350 of adjacent light fixtures 200, 300, 300'. Such electrical connection may occur by joining the electrical cables 357 or wires with a connector 358, such as a closed end connector, terminal, boot or other similar piece that retains the cables 357 from different light arrays 35 in electrical connection or proximity with one another. The adjacent light fixtures 200, 300, 300' may also be physically and mechanically connected to one another, such as by securing the joining member 311 of the housing 310, 310' of the adjustable light fixture 300, 300' with a similar joining member 211, 311 on the adjacent light fixture 200, 300, 300'. The joining members 311, 211 may be correspondingly shaped and configured to provide a fit for continuous and/or seamlessly joining the adjacent light fixtures 200, 300, as depicted in FIG. 17. Once installed and connected to adjacent fixtures in the lighting system 100, adjacent light fixtures 200, 300, 300' provide continuous and even light emanating from the fixtures, such as from one light array of one light fixture to adjacent light array of the adjacent light fixture. The light emanating from adjacent light fixtures 200, 300, 300' may vary by no more than 50% in some embodiments, no more than 20% in some embodiments, not more than 10% in certain embodiments, and not more than 5% in still other embodiments. Accordingly, the lighting system 100 collectively provides continuous and even illumination across the entire room or space, even up to the edges of the room.

In some embodiments, the adjustable light fixture 300 may also include trim 360, as shown in FIGS. 4 and 5, which may be cut in the field to accommodate the selected length of the adjustable light fixture 300. Such trim 360 and other escutcheons are commonly known in the lighting art, and may be any suitable material, such as but not limited to steel, aluminum, other metals, plastics, and may be painted or finished for various aesthetics. The trim 360 is mountable to the housing 310, such as at the opening of the interior 313, and may be mounted thereto at any time after the housing 310 is set to the selected desired length.

Similarly, in some embodiments the adjustable light fixture 300, 300' may include a lens 370 that is positionable between the light sources 352 and the space or room to be illuminated. The lens 370 may also be cut to size in the field to match or correspond to the selected length of the adjustable light fixture 300, 300', as depicted in FIGS. 4 and 22. The lens 370 may be made of any suitable material, such as but not limited to plastics, vinyls, glass, and polycarbonates, and may be transparent, translucent, frosted, patterned, colored, or any combination thereof. The lens 370 may be a snap-in lens that deforms slightly for insertion and resiliently returns to its form when tension is released. In other embodiments, the lens 370 may be of a "lift and shift" type where it is inserted into the interior 313 of the housing 310, 310' at an angle, and is then leveled out to cover the opening of the housing 310, 310'. The trim 360 may be used to retain the lens 370 in position. Collectively, the trim 360 and lens 370 may provide decorative finishing to adjustable light fixture 300 and lighting system 100.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. An adjustable light fixture, comprising:

a tray having:

(i) a longitudinal axis:

(ii) a first plate having:

(A) a first side and a second side;

(B) a plurality electroluminescent light sources disposed in an even distribution along said first side;

(C) a first slot extending between said first side and said second side along at least a portion of the length thereof parallel to said longitudinal axis;

(D) a first locking pin extending outwardly from at least one of said first and second sides; and (iii) a second plate selectively engageable with and movable relative to said first plate along said longitudinal axis, said second plate having:

(A) a first side and a second side;

(B) a plurality of electroluminescent light sources disposed in an even distribution along said first side;

(C) a second slot extending between said first side and said second side along at least a portion of the length thereof parallel to said longitudinal axis; and (D) a second locking pin extending outwardly from at least one of said first and second sides; and said respective first and second slots adapted to receive respective second and first locking pins;

wherein said first and second plates combine to provide continuous and uniformly luminous light from said tray along said longitudinal axis irrespective of placement of said first plate relative to said second plate.

2. The adjustable light fixture as recited in claim 1, wherein said first and second plates are configured to at least one of abut in an adjacent orientation and selectively engage to form an overlap region of length.

3. The adjustable light fixture as recited in claim 2, wherein to the extent said first and second plates engage to form an overlap region, said electroluminescent light sources of said first plate are obscured by said second plate.

4. The adjustable light fixture as recited in claim 3, wherein said first and second plates of said tray are spaced apart a preselected distance that exceeds a height dimension of said plurality of electroluminescent light sources, permitting said first and second plates to be selectively movable relative to one another along said longitudinal axis free of engagement of said plurality of electroluminescent light sources.

5. The adjustable light fixture as recited in claim 3, wherein said tray is selectively adjustable along said first and second slots between an extended position where said overlap region is minimized and a condensed position where said overlap region is maximized.

6. The adjustable light fixture as recited in claim 1, wherein said plurality of electroluminescent light sources are light emitting diodes (LEDs).

7. The adjustable light fixture as recited in claim 1, wherein said plurality of electroluminescent light sources on said first plate and said second plate are aligned.

8. The adjustable light fixture as recited in claim 1, wherein first and second plates combine to provide uniformly luminous light from said tray that varies by less than 5% along said axis of said tray.

9. A lighting system for illuminating a space, comprising:

a plurality of light fixtures each having at least one electroluminescent light source, said plurality of light fixtures configured to be electrically connected to one another;

wherein at least one of said plurality of light fixtures is an adjustable light fixture as recited in claim 1 and said lighting system is configured to provide uniformly luminous light collectively across said plurality of light fixtures.

10. The lighting system as recited in claim 9, wherein said lighting system includes at least one stationary light fixture having a fixed length and a plurality of electroluminescent light sources disposed along said fixed length configured to provide uniform light from said at least one stationary light fixture.

11. The lighting system as recited in claim 9, wherein each of said plurality of light fixtures has a first end and an opposite second end, said first end of one of said plurality of light fixtures being configured to connect to said second end of an adjacent one of said plurality of light fixtures.

12. The lighting system as recited in claim 11, wherein said plurality of electroluminescent light sources from adjacent ones of said plurality of light fixtures are configured to electrically connect.

13. The lighting system as recited in claim 11, wherein said plurality of electroluminescent light sources from adjacent ones of said plurality of light fixtures are aligned.

14. The lighting system as recited in claim 11, wherein said lighting system is configured to cover a continuous length of said space to be illuminated.

15. The lighting system as recited in claim 9, wherein said lighting system is configured to cover an entire length of the space to be illuminated.

16. The lighting system as recited in claim 9, wherein said lighting system is at least one of mountable to a surface and mountable in said surface of a space to be illuminated, said surface being at least one of a ceiling, wall, and floor.

17. An adjustable light fixture, comprising:

a housing having;

(i) a housing axis, (ii) a first portion having a length along said housing axis, and (iii) a second portion having a length along said housing axis and selectively engageable with said first portion along said housing axis;

a tray mountable to said housing and having:

(i) a tray axis parallel to said housing axis, (ii) a first plate having:

a. a first side and a second side;

b. a plurality of electroluminescent light sources disposed in an even distribution along said first side;

c. a first slot extending between said first side and said second side along at least a portion of the length thereof parallel to said longitudinal axis;

d. a first locking pin extending outwardly from at least one of said first and second sides; and (iii) a second plate selectively engageable with said first plate and movable relative to said first plate along said tray axis, said second plate having:

a. a first side and a second side;

b. a plurality of electroluminescent light sources disposed in an even distribution along said first side;

c. a second slot extending between said first side and said second side along at least a portion of the length thereof parallel to said longitudinal axis; and d. a second locking pin extending outwardly from at least one of said first and second sides; and said respective first and second slots adapted to receive respective second and first locking pins;

said first and second plates combinable to provide continuous and uniformly luminous light from said tray along said tray axis irrespective of placement of said first plate relative to said second plate; and said tray mountable to said housing such that said second sides of said first and second plates face said housing.

18. The adjustable light fixture as recited in claim 17, wherein at least one of (i) said second portion of said housing is slidably engageable with said first portion of said housing, and (ii) said second plate of said tray is slidably engageable with said first plate of said tray.

19. The adjustable light fixture as recited in claim 18, wherein at least one of said second portion of said housing is telescopically adjustable with said first portion of said housing and said second plate of said tray is telescopically adjustable with said first plate of said tray.

20. The adjustable light fixture as recited in claim 17, wherein said first and second plates are configured to at least one of abut one another in an adjacent orientation and selectively engage one another to form an overlap region of variable length.

21. The adjustable light fixture as recited in claim 20, wherein to the extent said first and second plates engage to form an overlap region, said electroluminescent light sources of said first plate are obscured by said second plate.

22. The adjustable light fixture as recited in claim 21, wherein said first and second plates of said tray are spaced apart a preselected distance that exceeds a height dimension of said plurality of electroluminescent light sources, permitting said first and second plates to be selectively movable relative to one another along said tray axis free of engagement of said plurality of electroluminescent light sources.

23. The adjustable light fixture as recited in claim 21, wherein said tray is selectively adjustable along said first and second slots between an extended position where said overlap region is minimized, and a condensed position where said overlap region is maximized.

24. The adjustable light fixture as recited in claim 17, wherein said first and second plates of said tray are independently adjustable from said first and second portions of said housing.

25. The adjustable light fixture as recited in claim 17, wherein at least one of said housing and said tray are telescopically adjustable.

26. The adjustable light fixture as recited in claim 17, wherein said plurality of electroluminescent light sources are light emitting diodes (LEDs).

27. The adjustable light fixture as recited in claim 17, wherein said plurality of electroluminescent light sources on said first plate and said second plate are aligned.

28. The adjustable light fixture as recited in claim 17, wherein said housing is mountable to a surface of a space to be illuminated, said surface being at least one of a ceiling, wall, and floor.

29. The adjustable light fixture as recited in claim 17, wherein said housing having a top and at least one side surface collectively defining an interior, and said tray is mountable within said interior with said plurality of electroluminescent light sources facing away from said housing.

30. The adjustable light fixture as recited in claim 17, wherein said first and second plates combine to provide uniformly luminous light from said housing that varies by less than 5% along said housing axis.

31. A method of installing a lighting system in a defined space to be illuminated, comprising:

selecting at least one adjustable light fixture;

defining a target region in said defined space;

moving first and second plates of a tray of said adjustable light fixture relative to one another along first and second slots in said first and second plates, respectively, along a tray axis to a selected tray length corresponding to said target region, wherein each of said first and second plates has a plurality of electroluminescent light sources disposed uniformly there along;

mounting said tray having said selected tray length to said target region of said defined space; and forming a uniform light distribution along said defined space emanating from said adjustable light fixture.

32. The method as recited in claim 31, wherein said target region is at least one of a surface and an opening in said defined space.

33. The method as recited in claim 31, further comprising connecting said adjustable light fixture to an adjacent light fixture.

34. The method as recited in claim 33, wherein connecting includes at least one of electrically connecting said electroluminescent light sources of said adjustable light fixture to an adjacent light fixture, and physically connecting a housing of said adjustable light fixture to a housing of an adjacent light fixture.

35. The method as recited in claim 31, further comprising cutting a lens corresponding to said selected tray length and connecting said lens to said tray between said electroluminescent light sources and said defined space to be illuminated.

36. The method as recited in claim 31, further comprising setting a selected length of a housing of said adjustable light fixture, mounting said housing of said selected length to said target region, and mounting said tray having said selected tray length to said housing.

37. The method as recited in claim 36, wherein setting a selected length of said housing includes at least one of cutting said housing to said selected length and moving first and second portions of said housing relative to one another along a housing axis.

38. The method as recited in claim 37, further comprising the steps of:

(i) moving first and second portions of said housing relative to one another along a housing axis to a selected housing length;

(ii) moving first and second plates of said tray having electroluminescent light sources disposed thereon relative to one another along said tray axis to a selected tray length, wherein said selected tray length corresponds to said selected housing length;

(iii) mounting said tray to said housing; and (iv) mounting said housing to said surface of said space to be illuminated.

39. The method as recited in claim 37, further comprising the steps of:

(i) moving first and second portions of said housing relative to one another along a housing axis to a selected housing length;

(ii) mounting said housing to said surface of said space to be illuminated;

(iii) moving first and second plates of said tray having electroluminescent light sources disposed thereon relative to one another along said tray axis to a selected tray length, wherein said selected tray length corresponds to said selected housing length; and (iv) mounting said tray to said housing.

40. The method as recited in claim 36, further comprising cutting trim corresponding to said selected housing length and connecting said trim to said housing.

* * * * *